US011480008B1

(12) United States Patent
Heming

(10) Patent No.: US 11,480,008 B1
(45) Date of Patent: Oct. 25, 2022

(54) WINDOW TRIM FOR REPLACEMENT WINDOWS

(71) Applicant: Trim-Fast, LLC, Quincy, IL (US)

(72) Inventor: Steven A. Heming, Quincy, IL (US)

( * ) Notice: Subject to any disclaimer, the term of this patent is extended or adjusted under 35 U.S.C. 154(b) by 0 days.

(21) Appl. No.: 17/705,799

(22) Filed: Mar. 28, 2022

(51) Int. Cl.
*E06B 1/62* (2006.01)
*E04F 19/02* (2006.01)
*E04F 13/06* (2006.01)

(52) U.S. Cl.
CPC ..... *E06B 1/62* (2013.01); *E04F 19/022* (2013.01); *E04F 13/06* (2013.01); *E06B 2001/628* (2013.01)

(58) Field of Classification Search
CPC ..... E06B 1/62; E06B 2001/628; E04F 2013/063; E04F 13/06; E04F 13/042; E04F 19/022; E04F 2013/066; Y10T 428/28; Y10T 428/2457
See application file for complete search history.

(56) References Cited

U.S. PATENT DOCUMENTS

| | | | | |
|---|---|---|---|---|
| 3,200,547 | A | 8/1965 | Johnson | |
| 4,289,818 | A * | 9/1981 | Casamayor | A47K 3/284 52/287.1 |
| 4,977,718 | A | 12/1990 | Hoffman, Sr. | |
| 5,059,476 | A | 10/1991 | Steiniger et al. | |
| 5,246,775 | A | 9/1993 | Loscuito | |
| 5,531,050 | A | 7/1996 | Stibolt et al. | |
| 5,657,955 | A | 8/1997 | Adams | |
| 5,705,002 | A * | 1/1998 | Sherry | E04F 19/0495 156/289 |
| 5,912,026 | A | 6/1999 | Gokcen et al. | |
| 6,001,200 | A | 12/1999 | Hibler | |
| 6,141,909 | A * | 11/2000 | Hanson | E06B 7/367 160/40 |
| 7,220,472 | B2 | 5/2007 | Rivest | |
| 7,785,684 | B2 | 8/2010 | Halle | |
| 7,943,222 | B2 | 5/2011 | Rivest | |
| 8,530,037 | B2 | 9/2013 | Halle | |
| 2002/0108326 | A1 | 8/2002 | Ackerman, Jr. | |
| 2005/0113511 | A1 * | 5/2005 | Mead | C08K 3/22 428/323 |

FOREIGN PATENT DOCUMENTS

| | | | | |
|---|---|---|---|---|
| EP | 0449733 | A1 * | 3/1991 | |
| EP | 1022406 | B1 | 10/2005 | |
| ES | 2112554 | T3 * | 4/1998 | B32B 27/06 |
| GB | 2224049 | A * | 4/1990 | E04F 19/06 |
| GB | 2224049 | B | 9/1992 | |
| WO | 2005106176 | A1 | 11/2005 | |

OTHER PUBLICATIONS

Translation of WO 2005106176.
Translation of EP 1022406.

* cited by examiner

*Primary Examiner* — Brian D Mattei
*Assistant Examiner* — Omar F Hijaz
(74) *Attorney, Agent, or Firm* — Grace J. Fishel

(57) ABSTRACT

An adhesive backed window trim bendable and divisible along a hinge separating the trim into two strips with score lines in each strip. A nub is formed along the side edges of the window trim for use in providing a finished edge concealing the adhesive when the undivided trim or the trim strips are used during installation of a replacement window or the like. The trim is co-extruded from a rigid PVC and plasticized PVC with shallow furrows on the rear face forming the score lines.

9 Claims, 3 Drawing Sheets

WINDOW TRIM FOR REPLACEMENT WINDOWS

BACKGROUND OF THE INVENTION

Field of the Invention

The present invention relates to an adhesive backed window trim bendable and divisible along a hinge separating the trim into two strips with score lines in each strip. The window trim and strips are structured to be easily made to fit a desired preexisting window frame or wall space surrounding a preexisting window with a nub along the side edges providing a finished outer edge.

Brief Description of the Prior Art

Updating a home with replacement windows is a common home improvement. The most cost effective replacement for existing windows involves removing the existing window and replacing it with a vinyl or fiberglass window slightly smaller than the one taken out. During installation the smaller replacement window is set into the window opening and shims added where necessary such that the window is plumb and level. After securing the window into the window opening, insulation is installed around window opening filling the gap between the replacement window and the opening. As a finishing step, a window trim is installed to cover the gap.

There are extruded metal and plastic parts that can be inserted into the gap but that requires the installer to have an inventory of different sized parts or to cut parts to size on site. That problem has been addressed with flat strips of plastic that are adhesively applied to the replacement window frame extending over the gap.

Commercially available window trim strips have an adhesive edge along one side and score lines such that the width of the trim may be adjusted to fit the installation. The adhesive edge is applied to the frame of the replacement window with the trimmed edge extending to the window opening. While the window trims may have a smooth outer surface and be cosmetically acceptable, either the adhesive may show around the periphery of the frame or if the adhesive is inset provides a dirt catching space. Aesthetically both are undesirable.

BRIEF SUMMARY OF THE INVENTION

In view of the above, it is an object of the present invention to provide a window trim providing a finished outer edge in use. Other objects and features of the invention will be in part apparent and in part pointed out hereinafter.

In accordance with the present invention, a substantially flat, elongated, extruded window trim has the following features:

(a) a front face and a rear face and first and second elongated side edges with a raised nub on the rear face along the first and second side edges;

(b) a longitudinally extending web formed of a plasticized PVC co-extruded with first and second lands formed of rigid PVC, said web forming a flat live hinge;

(c) at least one score line in the rear face of each of the first and second lands flanking and parallel to the web;

(d) a first band of adhesive affixed to the rear face of the first land inboard of the nub along first edge and extending proximate the score line and a second band of adhesive affixed to the rear face of the second land inboard of the nub along the second edge and extending proximate the score line; and, (e) a first removable backing on the first band of adhesive and a second removable backing on the second band of adhesive.

In a preferred embodiment, the the web bisects the trim into first and second elongated strips, each of which has score lines that are substantially U-shaped, straight and parallel. In those embodiments where the window trim is bendable about the web and coilable along its length, a PVC plasticized with a phthalate ester may be used to form the web with the lands forming the strips co-extruded from rigid regrind PVC.

The invention summarized above comprises the constructions hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 1:
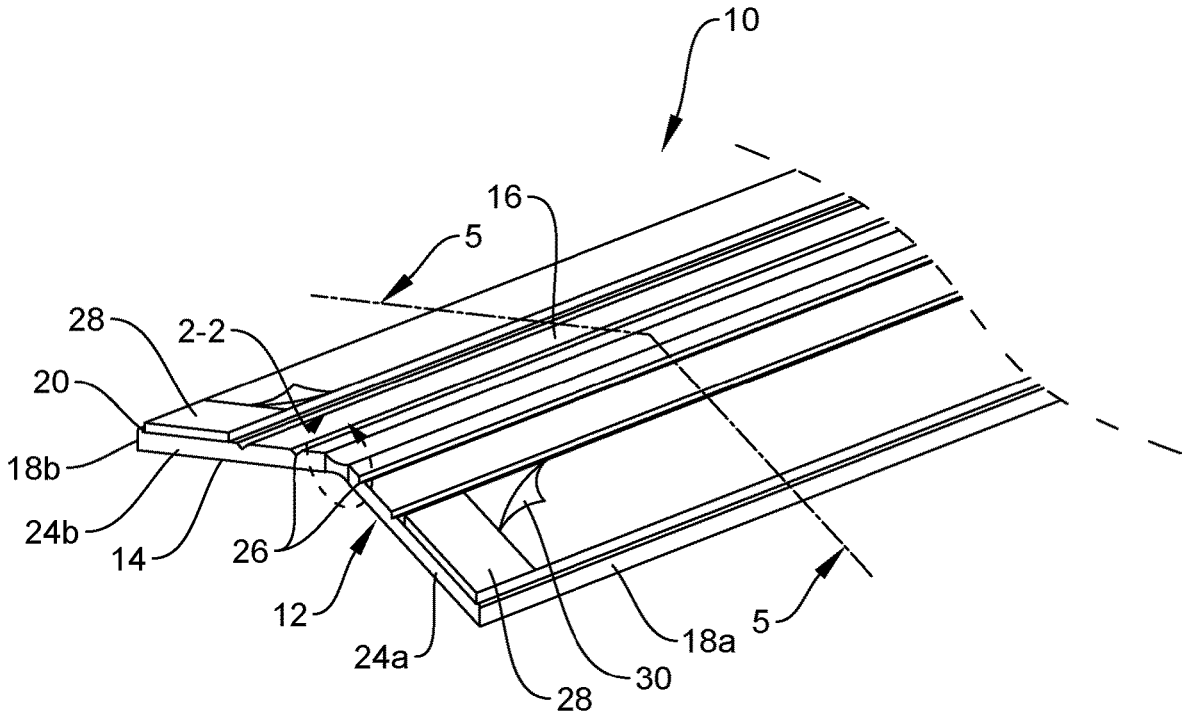
FIG. 1 is a perspective view of a window trim in accordance with the present invention showing the trim being bent around a web forming a flat live hinge for use in an inside corner.
Figure 2:
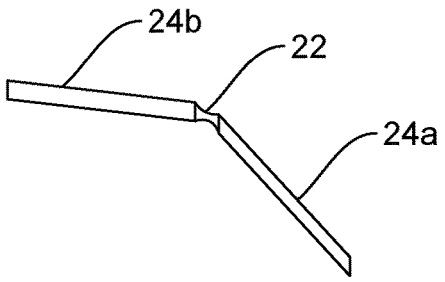
FIG. 2 is a detail taken along the line 2-2 in FIG. 1.
Figure 3:
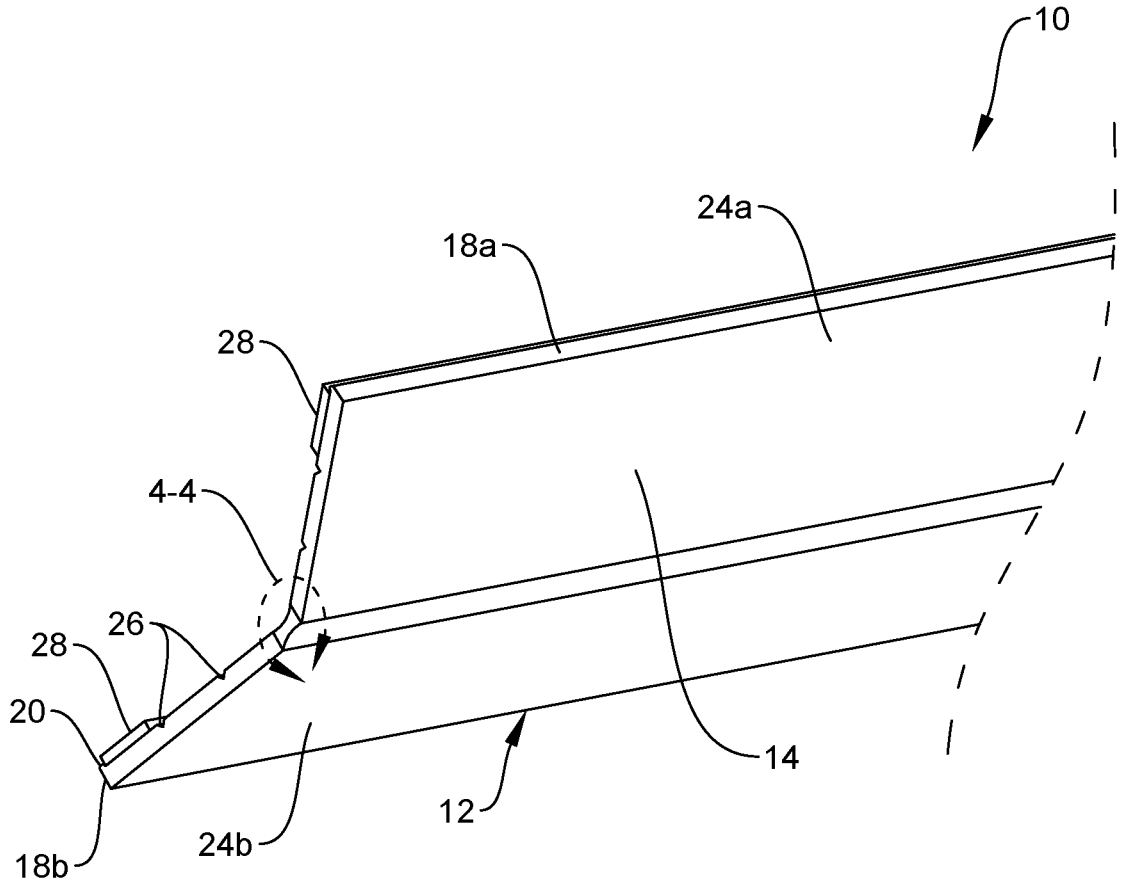
FIG. 3 is a perspective view showing the trim being bent for use around an outside corner.
Figure 4:
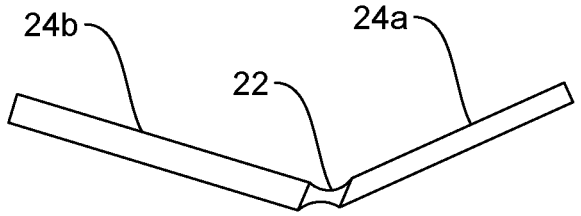
FIG. 4 is a detail taken the line 4-4 in FIG. 3.

Referring to the drawings more particularly by reference character window trim 10 comprises a flat, elongated polymeric member 12 having a front face 14, a rear face 16 and first and second elongated side edges 18*a*, 18*b*. Front face 14 may be smooth and colored to match or contrast with the replacement window frame or patterned. A raised nub 20 is formed on rear face 16 along side edges 18*a*, 18*b* for use as described below.

A longitudinally extending web 22 in the form of a flat live hinge divides polymeric member 12 into first and second strips 24*a*, 24*b* respectively. One or more shallow score lines 26 are provided in rear face 16 of strips 24*a*, 24*b*. As shown, score lines 26 are substantially straight, parallel and U-shaped in cross section.

An adhesive strip 28 is applied to rear face 16 of strips 24*a*, 24*b* inboard of the nubs 20 along side edges 18*a*, 18*b* in a conventional manner, for example by extrusion on the trim. After application of adhesive strip 18, a removable backing 30 may be applied to the adhesive. Alternatively, adhesive strip 28 may be applied as a double sided tape with a removable backing 30. The adhesive strip on each section of polymeric member 12 extends towards web 22 up to but not over the first score line 26.

Polymeric member 12 is preferably co-extruded. A stream of flexible PVC from an extruder is precisely positioned to join a main flow of rigid PVC from a primary extruder while both streams are in a molten state. As the streams flow together through a die, web 22 and first and second strips 24*a*, 24*b* are formed and bonded together. In a preferred form, the rigid PVC is regrind PVC and the plasticizer in the flexible PVC is diisonyl phthalate and the regrind PVC and plasticized PVC are white. With the specific regrind PVC and plasticized PVC window trim 10 is flexible enough that it may be coiled for shipment or storage.

In addition to forming web 22, the extrusion die has one or more small teeth which create shallow furrows on rear face 16 of strips 24*a*, 24*b*. These furrows form score lines 26 that can then be used as guides for a knife to cut the trim as discussed below. The furrows are preferably shallow and score lines 26 U-shaped to avoid the potential for shrink lines to form on front face 14 marring the appearance of window trim 10.

Figure 5:
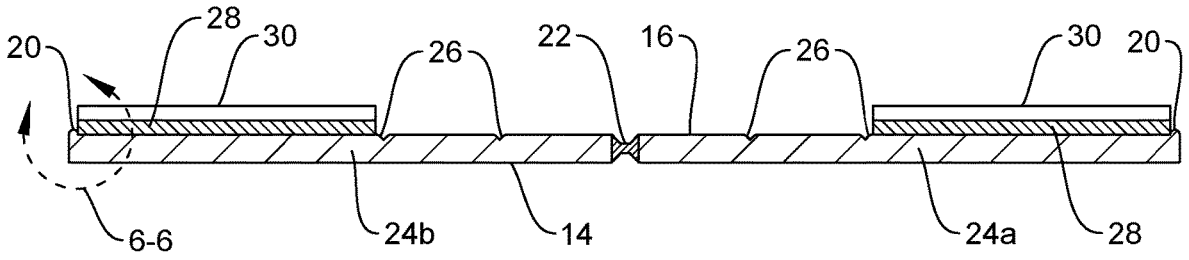
FIG. 5 is a cross section taken along the plane of 5-5 in FIG. 1; and, FIG. 6 is a detail on an enlarged scale taken along the line of 6-6 in FIG. 5.
Figure 6:
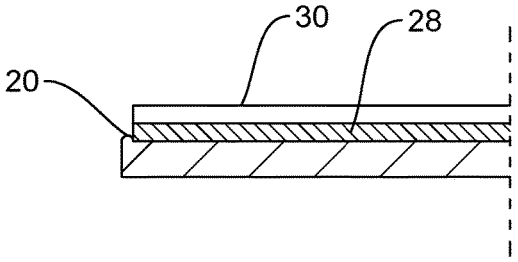

In one embodiment shown in FIG. 5, window trim 10 is substantially 2.5 inches wide and web 22 is substantially 0.063 inches wide. First and second strips 24*a*, 24*b* are substantially 0.063 inches thick and web 22 at is thinnest point is substantially 0.022 inches thick. As shown, adhesive strips 28 are positioned inboard nubs 20 and extends to first score line 26 in the direction of web 22. It will be understood that the above dimensions are illustrative and not limiting other than the adhesive strip should not cover any of the score lines.

In use, window trim 10 may be bent upwardly or downwardly as many times as needed without breaking to facilitate fitting difficulties during installation as shown in FIGS. 1-4. Once bent generally into shape, web 22 may be pushed into a corner or over an edge and backing 30 removed from one a strips 24*a*, 24*b* and applied to one side of the window frame or wall opening. The backing from the other of strips 24*a*, 24*b* is removed and the strip applied to the other side of the window frame or wall opening.

If two equal strips 24*a*, 24*b* better fit installation requirements, a razor knife may be passed down web 22 dividing polymeric member 12 into first and second strips 24*a*, 24*b*. The replacement window is measured and strips 24*a*, 24*b* cut to length. If strips 24*a*, 24*b* need to be sized other than cut to length, a razor knife may be passed down a selected score line 26 to make the groove deep enough that the strip may be broken along the score line. After the strip is sized, backing 30 is pulled off adhesive strip 28 and the finished side edge with nub 20 is applied to the window frame with the cut edge towards the window opening. Pressure may be applied on front face 14 over adhesive strip 28 with a roller or the like such that the adhesive is flattened and nub 20 provides a finished edge concealing the adhesive. In like manner the full width of window trim 10 as described above may be flattened against the supporting surface such that the adhesive does not show to provide a finished edge.

In view of the above, it will be seen that the object of the invention is achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A substantially flat, elongated, extruded window trim comprising:

(a) a flat front face and a flat rear face and first and second elongated side edges with a raised nub on the flat rear face along the first and second side edges;

(b) a longitudinally extending web formed of a plasticized PVC co-extruded with first and second lands formed of rigid PVC, said web forming a flat live hinge with a bowtie shape between the first and second lands for dividing the window trim into first and second strips;

(c) at least one score line in the rear face of each of the first and second lands flanking and parallel to the web;

(d) a first band of adhesive affixed to the rear face of the first land inboard of the nub along first edge and extending proximate the score line and a second band of adhesive affixed to the rear face of the second land inboard of the nub along the second edge and extending proximate the score line, said nub forming a unitary extension of each land along the first and second side edges concealing the first and second band of adhesive respectively when the window trim is flattened in use; and, (e) a first removable backing on the first band of adhesive and a second removable backing on the second band of adhesive.

2. The window trim of claim 1 wherein the score lines are substantially U-shaped.

3. The window trim of claim 1 having a plurality of spaced apart score lines in the rear face of each of the first and second lands.

4. The window trim of claim 3 wherein the score lines are substantially straight and substantially parallel.

5. A substantially flat, elongated, extruded window trim comprising:

(a) a flat front face and a flat rear face and first and second elongated side edges with a raised nub on the flat rear face along the first and second side edges;

(b) a longitudinally extending web formed of a PVC plasticized with a phthalate ester and co-extruded with first and second lands formed of rigid regrind PVC, said web forming a flat live hinge with a bowtie shape between the first and second lands for dividing the window trim into first and second strips;

(c) at least one score line in the rear face of each of the first and second lands flanking and parallel to the web;

(d) a first band of adhesive affixed to the rear face of the first land inboard of the nub along first edge and extending proximate the score line and a second band of adhesive affixed to the rear face of the second land inboard of the nub along the second edge and extending proximate the score line, said nub forming a unitary extension of each land along the first and second side edges concealing the first and second bands of adhesive when the window trim is flattened in use;

(e) a first removable backing on the first band of adhesive and a second removable backing on the second band of adhesive.

6. The trim of claim 5 wherein the plasticizer is diiosonyl phthalate.

7. The trim of claim 5 wherein the trim is substantially 2.5 inches wide and the web is substantially 0.063 inches wide.

8. The trim of claim 7 wherein the first and second lands are substantially 0.063 inches thick and the web at a thinnest point is substantially 0.022 inches thick.

9. The trim of claim 6 wherein the rigid regrind PVC and the PVC plasticized with phthalate ester are white.

* * * * *